US007063049B2

(12) United States Patent
Kemp et al.

(10) Patent No.: US 7,063,049 B2
(45) Date of Patent: Jun. 20, 2006

(54) DIRECTED SPRAY JET AND INSTALLATION TOOL

(75) Inventors: Dominic Alan Kemp, Waterloo, IA (US); Larry Linn Kriener, Waterloo, IA (US); Stanley Milton Jagodzinski, Cedar Falls, IA (US); Craig William Lohmann, Denver, IA (US)

(73) Assignee: Deere & Company, Moline, IL (US)

( * ) Notice: Subject to any disclaimer, the term of this patent is extended or adjusted under 35 U.S.C. 154(b) by 153 days.

(21) Appl. No.: 10/791,960

(22) Filed: Mar. 3, 2004

(65) Prior Publication Data

US 2005/0193964 A1 Sep. 8, 2005

(51) Int. Cl.
*F01P 1/04* (2006.01)

(52) U.S. Cl. ..... 123/41.35; 123/196 R

(58) Field of Classification Search ..... 123/41.35, 123/196 R

See application file for complete search history.

(56) References Cited

U.S. PATENT DOCUMENTS 6,298,810 B1 10/2001 Chimonides et al.
6,526,871 B1 3/2003 Zhu et al.
6,532,912 B1 * 3/2003 Moller et al. ..... 123/41.35
6,672,262 B1 1/2004 Bontaz

* cited by examiner

*Primary Examiner*—Tony M. Argenbright
*Assistant Examiner*—Katrina Harris

(57) ABSTRACT

A piston cooling spray jet, installation tool there for, and method for the installation of the spray jet in an engine cylinder block are provided. A piston cooling nozzle has a hollow main body portion adapted to be press fit into a through bore of the engine cylinder block. A first end of the through bore is located in a piston gallery and a second end of the through bore is located in the main bearing journal. The through bore intersects with an oil circuit in the cylinder block. The main body portion of the nozzle has an orientation feature. An installation tool has a main body portion adapted to mateably engage a surface of the main bearing journal. A cap screw extends through an aperture in the main body portion, and an orientation key affixed to the main body portion partially surrounds the cap screw.

12 Claims, 3 Drawing Sheets

DIRECTED SPRAY JET AND INSTALLATION TOOL

FIELD OF THE INVENTION

The present invention relates generally to internal combustion engines. More particularly, the present invention relates to systems for cooling and lubricating pistons in internal combustion engines. Specifically, the present invention relates to a piston cooling nozzle and installation tool there for.

BACKGROUND OF THE INVENTION

Previously it has been known to use cooling nozzles in internal combustion engines to direct a spray of oil to the underside of the pistons for the purpose of cooling and/or lubrication. It is known for each piston to be cooled with a spray of engine oil during operation. In advanced designs, the piston can be provided with an internal cooling circuit having an oil inlet and an oil outlet wherein the exact orientation of the nozzle is crucial for effective targeting of the spray towards the piston oil inlet during the down-stroke of the piston. To obtain the exact orientation, spray nozzles are frequently secured to a bracket which in turn is bolted to the engine casting, thus obtaining correct orientation via two fixed points. This results in extra hardware, extra manufacturing process and additional costs. Such nozzles have means for communicating with the oil gallery of the engine. Another known type of cooling nozzle is a cartridge style arrangement that is inserted in a through-bore from outside the cylinder block. The through-bore intersects the oil gallery and an orifice on the cartridge communicates oil from the gallery to the nozzle. This arrangement requires O-rings to prevent oil leakage. Another type of nozzle mounting arrangement is disclosed in U.S. Pat. No. 6,298,810 to Chimonides et al. This nozzle consists of an annular mounting collar having a cylindrical outer surface and a tube projecting generally radially from the mounting collar. The engine block is formed with a threaded bore that is drilled into the surface of the engine block to intersect the oil gallery. A special cap screw is inserted through the collar into the threaded bore to retain the collar to the cylinder block. The cap screw has special machining to allow oil to flow from the oil gallery to the nozzle. A locating pin is provided to maintain the radial position of the nozzle.

Accordingly, there is a clear need in the art for a method for properly orienting and securing a piston spray nozzle within an engine block using a single hole and a reusable mounting tool without the need for O-rings and additional mounting hardware.

SUMMARY OF THE INVENTION

In view of the foregoing, it is an object of the invention to provide a cooling nozzle for directing a flow of oil to a piston in an internal combustion engine.

Another object of the invention is the provision of an installation tool to facilitate proper installation and orientation of the cooling nozzle in the engine cylinder block.

Another object of the invention is to provide an improved method for installing and orienting a piston cooling nozzle in an engine cylinder block.

A further object of the invention is to provide a cooling nozzle mounting arrangement without the need for special mounting screws and/or o-rings.

An additional object of the invention is the provision of such a cooling nozzle mounting arrangement which is inexpensive to produce and is compatible with known manufacturing and assembly techniques and equipment.

The foregoing and other objects of the invention together with the advantages thereof over the known art which will become apparent from the detailed specification which follows are attained by a piston cooling spray jet and installation tool there for, comprising: a piston cooling nozzle, the nozzle having a hollow main body portion adapted to be press fit into a through bore of an engine cylinder block, a first end of the through bore located in a piston gallery and a second end of the through bore located in a main bearing journal, the through bore intersecting with an oil circuit in the cylinder block, a nozzle tube affixed thereto so that the nozzle tube is in fluid communication with a partially threaded interior passage in the hollow main body portion and with the oil circuit when the main body portion is mounted in the cylinder block, the main body portion of the nozzle further having an orientation feature; an installation tool comprising a main body portion adapted to mateably engage a surface of the main bearing journal, a cap screw extending through an aperture in the main body portion, and an orientation key affixed to the main body portion and partially surrounding the cap screw; wherein the nozzle is inserted into the through bore from a first side in the piston gallery and the installation tool is inserted in the through bore from a second side in the main bearing journal such that the main body portion of the installation tool mateably engages the surface of the main bearing journal while the cap screw and orientation key are received in the through bore; the cap screw is threaded into the interior passage of the main body portion of the nozzle and the orientation key of the installation tool mateably engages the orientation feature of the nozzle so that when the cap screw is tightened to a predetermined torque the nozzle is pulled into the through bore to a predetermined depth and at a predetermined orientation.

Other objects of the invention are attained by a cooling nozzle mounting arrangement comprising: an internal combustion engine cylinder block having: at least one piston gallery wherein a piston cylinder is located; at least one main bearing journal; an oil circuit; and, a through bore provided in the cylinder block having a first end located in the piston gallery and a second end located in the main bearing journal, the through bore intersecting with the oil circuit; a cooling nozzle comprising: a main body cartridge having a generally cylindrical portion with an interior passage located therein and an orientation feature extending from the cylindrical portion, the orientation feature being a semi-cylinder, the interior passage of the main body cartridge having threads at an end proximal to the orientation feature, the outside diameter of the cylindrical portion of the main body cartridge being selected to attain an appropriate press fit with the through bore; and, a nozzle tube having a first end and a second end affixed to the main body cartridge so that the tube is in communication with the interior passage thereof; an installation tool comprising: a main body portion having an aperture therein and having upper surfaces having a radius that matches a radius of the main bearing journal; an orientation key mounted in the aperture of the main body portion, the orientation key having a cylindrical portion with an interior bore and a semi-cylindrical portion; and, a cap screw having a threaded end and a head end, the cap screw being inserted in the orientation key bore from a lower side of the main body portion such that the threaded end extends out from the semi-cylindrical portion of the orientation key and the head is seated against a surface on a lower side of the main body portion, the interior bore of the orientation key being sized so that the cap screw can turn freely when disposed in the bore; wherein the main body cartridge of the nozzle is started in the through bore at the first end located in the piston gallery, the orientation key and cap screw are inserted in the second end of the through bore in the main bearing journal, the radius of the upper surfaces of the main body portion of the tool are brought into mating engagement with the radius of the main bearing journal, the cap screw is started in the threads of the interior passage of the nozzle, as the cap screw is torqued the main body cartridge of the nozzle is drawn into a press fit with the through bore, the orientation key of the tool being rigidly affixed to the main body portion and the semi-cylindrical portion of the key is matingly opposed by the semi-cylindrical orientation feature of the nozzle, so that the nozzle cannot rotate in the bore as the cap screw is torqued, and the second end of the through bore is sealed against oil leaks from the oil circuit intersecting the through bore when a main bearing is mounted in the main bearing journal.

Still other objects of the invention are attained by a cooling nozzle comprising: a main body cartridge having a generally cylindrical portion with an interior passage located therein and an orientation feature extending from the cylindrical portion, the orientation feature being a semi-cylinder, the interior passage of the main body cartridge having threads at an end proximal to the orientation feature, the outside diameter of the cylindrical portion of the main body cartridge being selected to attain an appropriate press fit with the through bore; and, a nozzle tube having a first end and a second end affixed to the main body cartridge so that the tube is in communication with the interior passage thereof.

Further objects of the invention are attained by an installation tool comprising: a main body portion having an aperture therein and having an upper surface having a radius that matches a radius of the main bearing journal; an orientation key mounted in the aperture of the main body portion, the orientation key having a cylindrical portion with an interior bore and a semi-cylindrical portion; a cap screw having a threaded end and a head end, the cap screw being inserted in the orientation key bore from a lower side of the main body portion such that the threaded end extends out from the semi-cylindrical portion of the orientation key and the head is seated against a surface on a lower side of the main body portion, the interior bore of the orientation key being sized so that the cap screw can turn freely when disposed in the bore.

Still further objects of the invention are attained by a method of mounting a piston cooling nozzle in an engine cylinder block comprising the steps of: providing a through bore in the cylinder block between a piston gallery and a main bearing journal, the through bore intersecting an internal oil circuit of the cylinder block; inserting a cooling nozzle assembly having an orientation feature in the through bore from the piston gallery; inserting an installation tool having an orientation key and a cap screw in the through bore from the main bearing journal; using a radiused upper surface of the installation tool to mateably align the tool with the main bearing journal; using the orientation feature of the cooling nozzle assembly and orientation key of the installation tool to establish a predetermined orientation of the nozzle within the piston gallery; threading the cap screw of the installation tool into the cooling nozzle assembly; tightening the cap screw to a predetermined torque so as to draw the cooling nozzle into a press fit with the through bore at a predetermined depth; and, unthreading the cap screw from the nozzle assembly and withdrawing the installation tool from the through bore.

In general, a piston cooling spray jet, installation tool there for, and method for the installation of the spray jet in an engine cylinder block are provided. A piston cooling nozzle has a hollow main body portion adapted to be press fit into a through bore of the engine cylinder block. A first end of the through bore is located in a piston gallery and a second end of the through bore is located in the main bearing journal. The through bore intersects with an oil circuit in the cylinder block. The main body portion of the nozzle has an orientation feature. An installation tool has a main body portion adapted to mateably engage a surface of the main bearing journal. A cap screw extends through an aperture in the main body portion, and an orientation key affixed to the main body portion partially surrounds the cap screw. The nozzle is inserted into the through bore from a first side in the piston gallery and the installation tool is inserted in the through bore from a second side in the main bearing journal such that the main body portion of the installation tool mateably engages the surface of the main bearing journal, while the cap screw and orientation key are received in the through bore. The cap screw is threaded into the interior passage of the main body portion of the nozzle and the orientation key of the installation tool mateably engages the orientation feature of the nozzle so that when the cap screw is tightened to a predetermined torque the nozzle is pulled into the through bore to a predetermined depth and at a predetermined orientation.

To acquaint persons skilled in the art most closely related to the present invention, one preferred embodiment of the invention that illustrates the best mode now contemplated for putting the invention into practice is described herein by and with reference to, the annexed drawings that form a part of the specification. The exemplary embodiment is described in detail without attempting to show all of the various forms and modifications in which the invention might be embodied. As such, the embodiment shown and described herein is illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF THE PREFERRED EMBODIMENT

Figure 1:
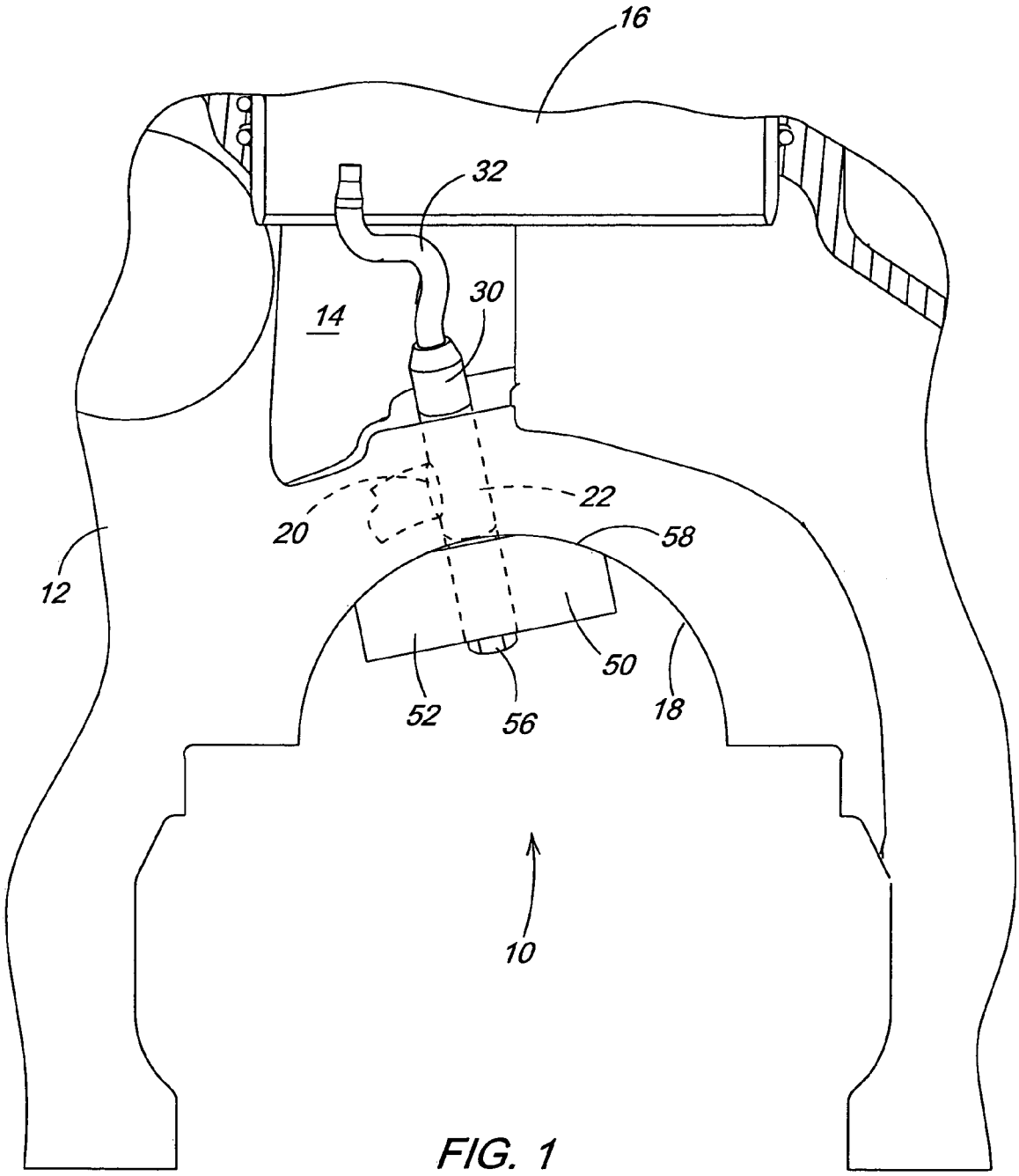
FIG. 1 is an elevational view of a section of an engine cylinder block illustrating the mounting arrangement according to the invention.
Figure 2:
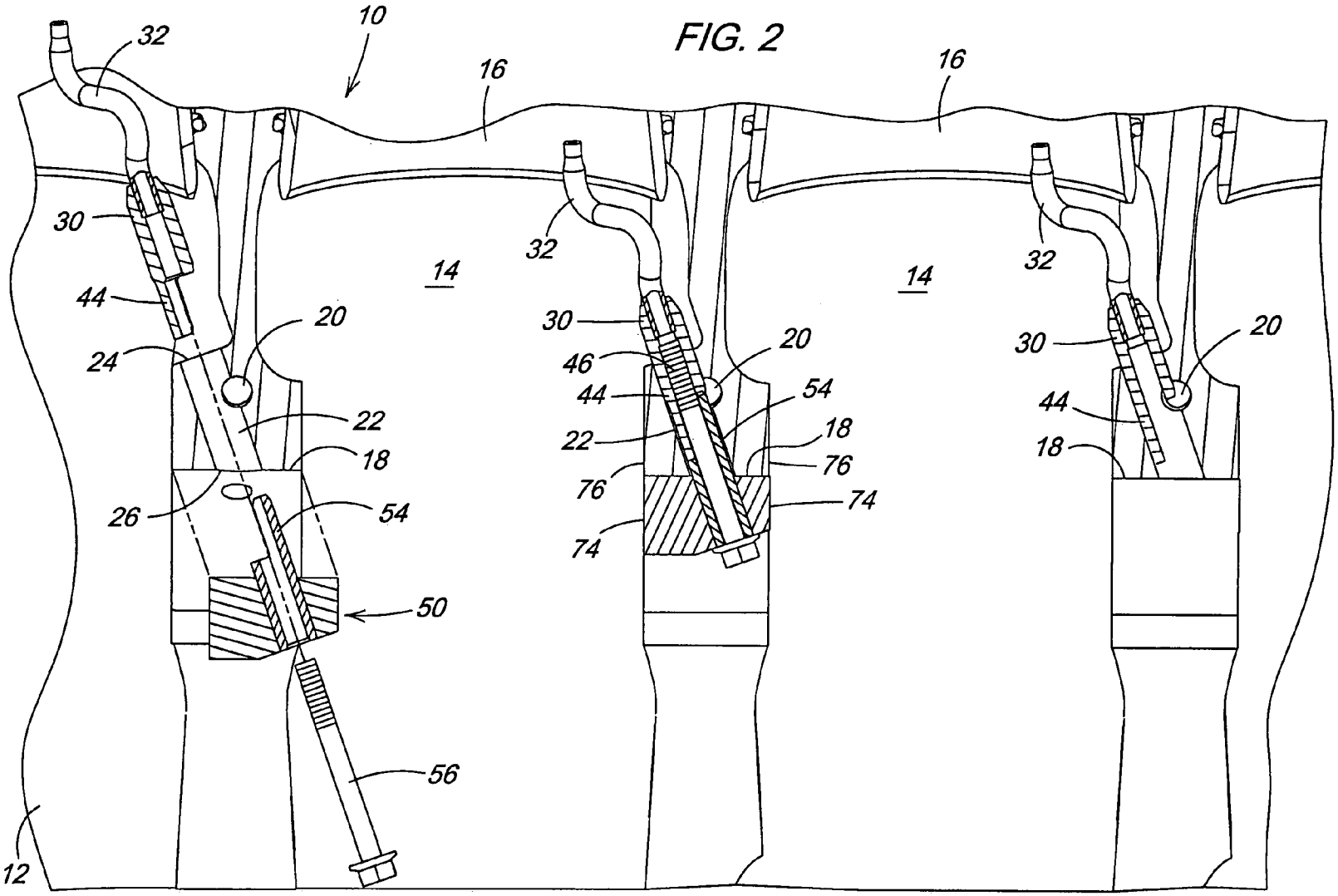
FIG. 2 is a cross-sectional view of an engine cylinder block showing three cylinders each in a different phase of assembly.

With reference now to the drawings and specifically to FIGS. 1 and 2 it can be seen that a cooling nozzle mounting arrangement according to the invention is designated generally by the numeral 10. The nozzle mounting arrangement 10 is adapted for use in an internal combustion engine cylinder block 12 such as in a diesel engine for example. The cylinder block 12 includes a piston gallery 14 wherein the individual cylinders 16 are located. A plurality of main bearing journals 18 are provided in the cylinder block 12. The cylinder block 12 further includes an oil circuit 20. A through bore 22 is provided in the cylinder block 12 and has a first end 24 located in the piston gallery 14 and a second end 26 located in the main bearing journal 18. The through bore 22 intersects with the oil circuit 20.

Figure 3:
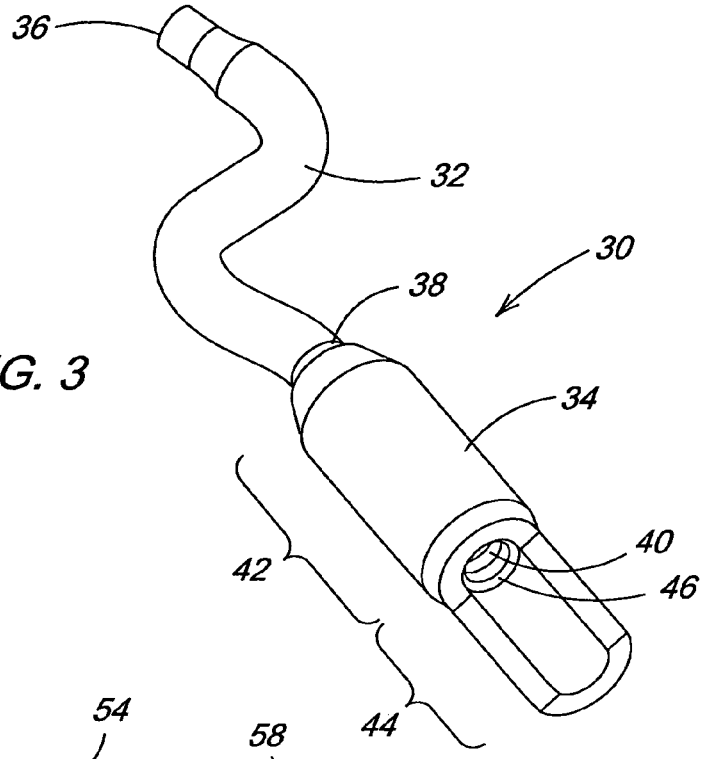
FIG. 3 is a perspective view of a cooling nozzle according to the invention; and, FIG. 4 is a perspective view of an installation tool according to the invention.

A cooling nozzle 30 is illustrated in FIG. 3. As shown the nozzle 30 includes a nozzle tube 32 affixed to a main body cartridge 34. The nozzle tube 32 is a tubular member and may have a serpentine profile as dictated by the particular application and includes a first end generally indicated at 36 and a second end generally indicated at 38. At least a portion of the outside diameter of the nozzle tube 32 proximal to the second end 38 thereof closely approximates the inside diameter of an interior passage 40 in the main body cartridge 34 so that a portion of the nozzle tube 32 can be mateably affixed within the interior passage 40 of the main body cartridge 34 to form the nozzle 30. The first end 36 of the nozzle tube 32 can be appropriately adapted to provide a spray pattern as desired for the particular application. As can be seen in the figures the main body cartridge 34 of the cooling nozzle 30 has a generally cylindrical portion 42 with the interior passage 40 located therein and having an orientation feature 44 extending from the cylindrical portion 42. The orientation feature 44 is a slightly reduced diameter cylinder of which a portion has been machined away so as to leave a semi-cylinder as shown. For reasons which will become apparent as the description continues the interior passage 40 of the main body cartridge 34 includes threads 46 at the end proximal to the orientation feature 44. Because the cooling nozzle 30 is adapted to be received in the through bore 22 of the cylinder block 12, the outside diameter of the cylindrical portion 42 of the main body cartridge 34 is selected to attain an appropriate press fit with the through bore 22.

Figure 4:
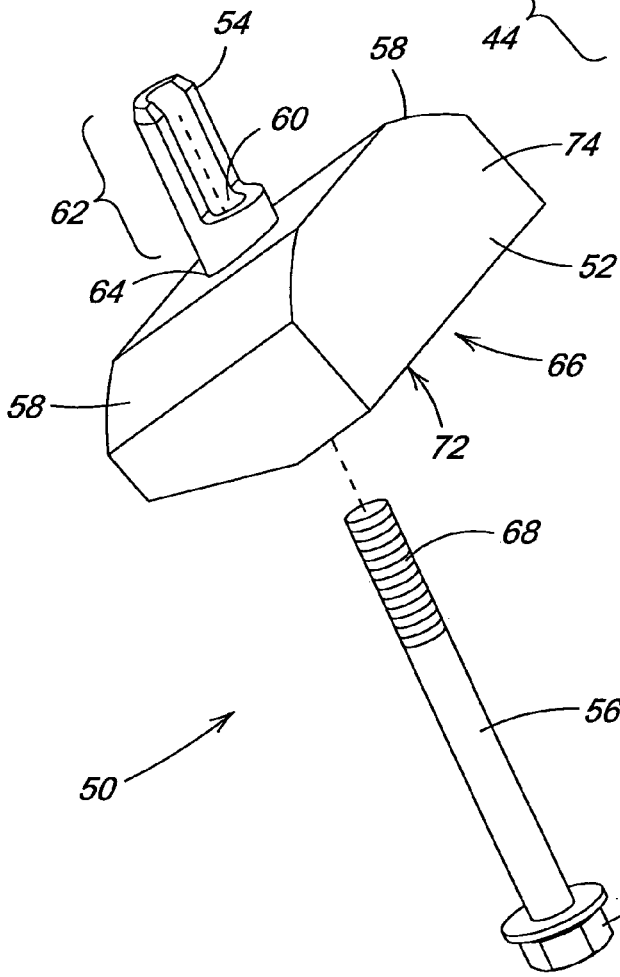

Referring now to FIG. 4 it can be seen that an installation tool 50 generally includes a main body portion 52, an orientation key 54, and a cap screw 56. The main body portion 52 has upper surfaces 58 having a radius that matches the radius of the main bearing journal 18. The orientation key 54 is a generally cylindrical member having an interior bore 60. The orientation key 54 further includes a semi-cylindrical portion 62 similar to that of the orientation feature 44 described above. The orientation key 54 is mounted in an aperture 64 provided in the main body portion 52. The cap screw 56 is inserted in the orientation key bore 60 from a first side 66 of the main body portion 52 such that the threaded end 68 extends out from the semi-cylindrical portion 62 of the orientation key 54 and the head 70 can seat against a surface 72 on the first side 66 of the main body portion 52. The interior bore 60 of the orientation key 54 is sized so that the cap screw 56 can turn freely when disposed in the bore 60.

The installation of the nozzle 30 to the cylinder block 12 using the installation tool 50 will now be described with reference to FIG. 2. As shown the nozzle 30 is started in the through bore 22 at the first end 24 located in the piston gallery 14. It is preferred to start the nozzle 30 in the bore 22 at as close to the desired final orientation as possible. The orientation key 54 and cap screw 56 are then inserted in the through bore 22 at the second end 26 in the main bearing journal 18. The radius of the upper surfaces 58 of the main body portion 52 of the tool 50 are then brought into mating engagement with the radius of the main bearing journal 18. At this point the sides 74 of the main body portion 52 of the tool 50 are parallel to the sides 76 of the main bearing journal 18 and the orientation key 54 is disposed in the bore 22 at the desired orientation. The cap screw 56 is then started in the threads 46 of the interior passage 40 of the nozzle 30. As the cap screw 56 is torqued the main body cartridge 34 of the nozzle 30 is drawn into a press fit with the through bore 22. The mating engagement of the orientation key 54 of the tool 50 with the orientation feature 44 of the nozzle 30 ensures proper orientation of the nozzle 30 within the bore 22 as the cartridge 34 is seated. More particularly, the orientation key 54 of the tool 50 is rigidly affixed to the main body portion 52 and the semi-cylindrical portion 62 of the key 54 is matingly opposed by the semi-cylindrical orientation feature 44 of the nozzle 30, as such the nozzle 30 cannot rotate in the bore 22 as the cap screw 56 is torqued. Those having skill in the art will recognize that the precise orientation of both the orientation key 54 of the tool 50 and the orientation feature 44 of the nozzle 30 are selected based upon the desired final orientation of the nozzle 30 within the piston gallery 14. The amount of torque required to fit the nozzle 30 in the bore 22 can be used as a guide to determine when the nozzle 30 is properly located. Once the required torque is determined through experimentation it is simply a matter of tightening the cap screw 56 to the same torque for each nozzle 30 being installed. By locating the second end of the through bore 22 in the main bearing journal 18 a convenient alignment is provided by mating the upper surfaces 58 of the tool 50 to the surface radius of the journal. Further, the second end 26 of the through bore 22 is sealed against oil leaks from the oil circuit 20 intersecting the bore 22 when the main bearings are mounted in the main bearing journals 18.

Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The embodiments of the invention in which an exclusive property or privilege is claimed are defined as follows:

1. A piston cooling spray jet and installation tool there for comprising:

a piston cooling nozzle, the nozzle having a hollow main body portion adapted to be press fit into a through bore of an engine cylinder block, a first end of the through bore located in a piston gallery and a second end of the through bore located in a main bearing journal, the through bore intersecting with an oil circuit in the cylinder block, a nozzle tube affixed thereto so that the nozzle tube is in fluid communication with a partially threaded interior passage in the hollow main body portion and with the oil circuit when the main body portion is mounted in the cylinder block, the main body portion of the nozzle further having an orientation feature;

an installation tool comprising a main body portion adapted to mateably engage a surface of the main bearing journal, a cap screw extending through an aperture in the main body portion, and an orientation key affixed to the main body portion and partially surrounding the cap screw;

wherein the nozzle is inserted into the through bore from a first side in the piston gallery and the installation tool is inserted in the through bore from a second side in the main bearing journal such that the main body portion of the installation tool mateably engages the surface of the main bearing journal while the cap screw and orientation key are received in the through bore; the cap screw is threaded into the interior passage of the main body portion of the nozzle and the orientation key of the installation tool mateably engages the orientation feature of the nozzle so that when the cap screw is tightened to a predetermined torque the nozzle is pulled into the through bore to a predetermined depth and at a predetermined orientation.

2. A cooling nozzle mounting arrangement comprising:

an internal combustion engine cylinder block having:

at least one piston gallery wherein a piston cylinder is located;

at least one main bearing journal;

an oil circuit; and, a through bore provided in the cylinder block having a first end located in the piston gallery and a second end located in the main bearing journal, the through bore intersecting with the oil circuit;

a cooling nozzle comprising:

a main body cartridge having a generally cylindrical portion with an interior passage located therein and an orientation feature extending from the cylindrical portion, the orientation feature being a semi-cylinder, the interior passage of the main body cartridge having threads at an end proximal to the orientation feature, the outside diameter of the cylindrical portion of the main body cartridge being selected to attain an appropriate press fit with the through bore; and, a nozzle tube having a first end and a second end affixed to the main body cartridge so that the tube is in communication with the interior passage thereof;

an installation tool comprising:

a main body portion having an aperture therein and having upper surfaces having a radius that matches a radius of the main bearing journal;

an orientation key mounted in the aperture of the main body portion, the orientation key having a cylindrical portion with an interior bore and a semi-cylindrical portion; and, a cap screw having a threaded end and a head end, the cap screw being inserted in the orientation key bore from a lower side of the main body portion such that the threaded end extends out from the semi-cylindrical portion of the orientation key and the head is seated against a surface on a lower side of the main body portion, the interior bore of the orientation key being sized so that the cap screw can turn freely when disposed in the bore;

wherein the main body cartridge of the nozzle is started in the through bore at the first end located in the piston gallery, the orientation key and cap screw are inserted in the second end of the through bore in the main bearing journal, the radius of the upper surfaces of the main body portion of the tool are brought into mating engagement with the radius of the main bearing journal, the cap screw is started in the threads of the interior passage of the nozzle, as the cap screw is torqued the main body cartridge of the nozzle is drawn into a press fit with the through bore, the orientation key of the tool being rigidly affixed to the main body portion and the semi-cylindrical portion of the key is matingly opposed by the semi-cylindrical orientation feature of the nozzle, so that the nozzle cannot rotate in the bore as the cap screw is torqued, and the second end of the through bore is sealed against oil leaks from the oil circuit intersecting the through bore when a main bearing is mounted in the main bearing journal.

3. A cooling nozzle mounting arrangement according to claim 2 wherein the nozzle tube has a serpentine profile.

4. A cooling nozzle mounting arrangement according to claim 2 wherein the first end of the nozzle tube is adapted to provide a predetermined spray pattern.

5. A cooling nozzle mounting arrangement according to claim 2 wherein first and second sides of the main body portion of the tool are parallel to first and second sides of the main bearing journal when the radiused upper surfaces of the main body portion is mated to the main bearing journal.

6. A cooling nozzle mounting arrangement according to claim 2 wherein the precise orientation of both the orientation key of the tool and the orientation feature of the nozzle are pre-selected based upon the desired final orientation of the nozzle within the piston gallery.

7. A cooling nozzle comprising:

a main body cartridge having a generally cylindrical portion with an interior passage located therein and an orientation feature extending from the cylindrical portion, the orientation feature being a semi-cylinder, the interior passage of the main body cartridge having threads at an end proximal to the orientation feature, the outside diameter of the cylindrical portion of the main body cartridge being selected to attain an appropriate press fit with the through bore; and, a nozzle tube having a first end and a second end affixed to the main body cartridge so that the tube is in communication with the interior passage thereof.

8. A cooling nozzle according to claim 7 wherein the nozzle tube has a serpentine profile.

9. A cooling nozzle according to claim 7 wherein the first end of the nozzle tube is adapted to provide a predetermined spray pattern.

10. An installation tool comprising:

a main body portion having an aperture therein and having an upper surface having a radius that matches a radius of the main bearing journal;

an orientation key mounted in the aperture of the main body portion, the orientation key having a cylindrical portion with an interior bore and a semi-cylindrical portion;

a cap screw having a threaded end and a head end, the cap screw being inserted in the orientation key bore from a lower side of the main body portion such that the threaded end extends out from the semi-cylindrical portion of the orientation key and the head is seated against a surface on a lower side of the main body portion, the interior bore of the orientation key being sized so that the cap screw can turn freely when disposed in the bore.

11. A method of mounting a piston cooling nozzle in an engine cylinder block comprising the steps of:

providing a through bore in the cylinder block between a piston gallery and a main bearing journal, the through bore intersecting an internal oil circuit of the cylinder block;

inserting a cooling nozzle assembly having an orientation feature in the through bore from the piston gallery;

inserting an installation tool having an orientation key and a cap screw in the through bore from the main bearing journal using a radiused upper surface of the installation tool to mateably align the tool with the main bearing journal;

using the orientation feature of the cooling nozzle assembly and orientation key of the installation tool to establish a predetermined orientation of the nozzle within the piston gallery;

threading the cap screw of the installation tool into the cooling nozzle assembly;

tightening the cap screw to a predetermined torque so as to draw the cooling nozzle into a press fit with the through bore at a predetermined depth; and, unthreading the cap screw from the nozzle assembly and withdrawing the installation tool from the through bore.

12. A method of mounting a piston cooling nozzle in an engine cylinder block according to claim 11 comprising the further step-of mounting a main bearing in the main bearing journal so as to seal the through bore at one end thereof.

* * * * *